United States Patent [19]

Haberski

[11] 3,981,354

[45] Sept. 21, 1976

[54] BUILT-UP TUBE AND TUBESHEET ASSEMBLY FOR MULTI-CONDUIT HEAT EXCHANGERS

[75] Inventor: Richard J. Haberski, Emerson, N.J.

[73] Assignee: Curtiss-Wright Corporation, Wood-Ridge, N.J.

[22] Filed: Mar. 28, 1975

[21] Appl. No.: 563,089

[52] U.S. Cl. ..... 165/79; 29/157.4; 165/125; 165/153; 165/175; 165/179

[51] Int. Cl.[2] ..... F28F 7/00

[58] Field of Search ..... 165/79, 153, 173, 175, 165/179, 181; 29/157.4

[56] References Cited

UNITED STATES PATENTS

| | | | |
|---|---|---|---|
| 1,265,340 | 5/1918 | Kaman | 165/79 |
| 2,339,284 | 1/1944 | Modine | 165/79 |
| 3,229,722 | 1/1966 | Kritzer | 165/181 |

FOREIGN PATENTS OR APPLICATIONS

| | | | |
|---|---|---|---|
| 574,450 | 1/1946 | United Kingdom | 165/153 |
| 793,525 | 4/1958 | United Kingdom | 165/153 |
| 806,300 | 12/1958 | United Kingdom | 165/153 |

*Primary Examiner*—C. J. Husar
*Attorney, Agent, or Firm*—Arthur Frederick; Victor D. Behn

[57] ABSTRACT

The built-up tube and tubesheet assembly for multi-conduit heat exchangers having a plurality of conduits each of which have end portions of four-sided polygonal shape in cross-section comprises a plurality of peripheral walls secured together to form a four-sided polygonal shaped frame and, at least, one partition wall connected at opposite ends to opposite peripheral walls to thereby form two openings shaped and dimensioned to receive therein the end portions of the conduits. A securing and sealing means is provided to connect the end portions of the conduits and the peripheral and partition walls together and seal the interstices between the surfaces of the end portions and the adjacent surfaces of the peripheral and partition walls. In the method of fabrication the securing and sealing means is provided by dip soldering or brazing within a molten solder bath.

11 Claims, 8 Drawing Figures

BUILT-UP TUBE AND TUBESHEET ASSEMBLY FOR MULTI-CONDUIT HEAT EXCHANGERS

The invention relates to tubular heat exchangers and, more particularly, to a built-up tube and tubesheet assembly for multi-conduit heat exchangers and the method of fabrication of such assembly.

BACKGROUND

In heat exchangers employing a multiplicity of conduits having a polygonal or oval configuration in cross-section, the fabrication of a fluidtight tubesheet in which the end portions of such conduits are supported is difficult and expensive. More specifically, the construction of non-circular openings in a plate type tubesheet and the subsequent securing of non-circular conduits, such as disclosed in the patent to Kritzer U.S. Pat. No. 3,229,722 dated Jan. 18, 1966, in those openings requires complex and expensive machining and bonding operations. In the built-up tube and tubesheet assembly according to this invention these disadvantages and shortcomings of prior apparatuses are overcome.

Accordingly, it is an object of this invention to provide a built-up tube and tubesheet assembly for supporting conduits of non-circular cross-section which assembly is relatively easy and inexpensive to fabricate. It is a further object to provide a built-up tube and tubesheet assembly having conduits of non-circular cross-section which assembly has structural integrity and optimum sealing of the joints between the tube elements and tubesheet. It is another object of the present invention to provide a method of fabricating a built-up tube and tubesheet assembly for supporting conduits of non-circular cross-section, which method is relatively simple and low in cost.

SUMMARY

Now, therefore, the present invention contemplates a built-up tube and tubesheet assembly for a heat exchanger having a plurality of conduits or tube elements each of which have end portions of non-circular cross-section such as oval or of four-sided polygonal shape. The tube elements may also be provided with extended surface elements or fins such as exemplified in the patent to Kritzer U.S. Pat. No. 3,229,722.

The built-up tube and tubesheet assembly comprises a plurality of elongated peripheral wall elements disposed relative to each other to form a frame of polygonal shape, the frame defining an enclosure. The peripheral wall elements are secured together in any suitable manner, such as welding, soldering, brazing or the like. One or more divisional or partition wall elements are disposed in the enclosure and with the opposite ends thereof secured to the peripheral wall elements to thereby form a plurality of openings adapted to receive therein the end portions of the tube elements. Securing and sealing means, such as solder brazing material or other suitable bonding material is provided to connect the end portions of the tube elements to the peripheral and partition wall elements and for sealing the interstices between the end portions of the tube elements and the adjacent peripheral and partition wall elements.

In a slightly narrower aspect of the present invention each of the surfaces of the end portions of the tube elements, and/or the adjacent surfaces of the peripheral and partition wall elements may be provided with spaced projections, such as teats integrally cast or machined in the surfaces or formed by localized mechanical deformation of the wall elements, commonly referred to as staking. These projections are dimensioned to hold the end portions of the tube elements in a predetermined close spaced relationship to the adjacent surfaces of the peripheral and partition wall element surfaces, which spacing is desirable for optimum bonding effectiveness. Means forming a manifold or header may be suitably secured to the tube and tubesheet assembly.

The method of fabrication according to this invention of a built-up tube and tubesheet assembly, as herein described, comprises the steps of first arranging a plurality of peripheral wall elements in abutment with each other and securing the peripheral wall elements together to form a frame having a polygonal configuration. The peripheral wall elements are secured together in any suitable manner such as soldering, tack welding or brazing, but preferably by welding where rigidity and strength for handling the assembly is necessary. Thereafter, a dividing or partition wall element is inserted within the frame and secured to peripheral wall elements to thereby form a plurality of openings dimensioned to receive the end portions of the tube elements. Following this step, the tube elements are placed in the openings and the peripheral and partition wall elements are bonded together and to the tube elements so as to seal the interstices between the adjacent surfaces of the tube elements and the peripheral and partition wall elements.

In a narrower aspect of the method according to this invention bonding and sealing is achieved by dipping the entire tube and tubesheet assembly, and/or the heat exchanger of whicch the tube and tubesheet assembly forms a part, in a fluxless zinc soldering bath utilizing a hot dip galvanizing apparatus such as disclosed in the patent to Hammer, U.S. Pat. No. 3,861,352, dated Jan. 21, 1975.

BRIEF DESCRIPTION OF THE DRAWINGS

The invention will be more fully understood from the following detailed description thereof when considered in connection with the accompanying drawing wherein two embodiments of the invention are illustrated by way of example, and in which.

DESCRIPTION OF THE PREFERRED EMBODIMENTS

Figure 1:
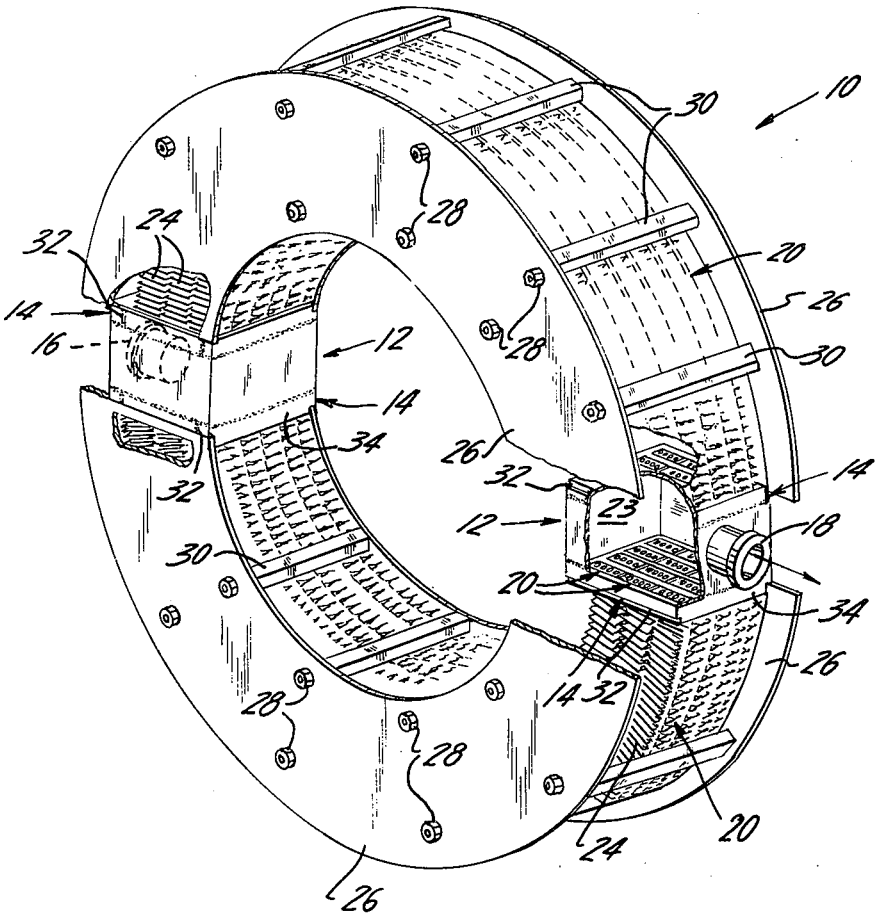
FIG. 1 is a view in perspective of a heat exchanger having tube and tubesheet assemblies according to this invention and with parts broken away for illustration purposes.
Figure 2:
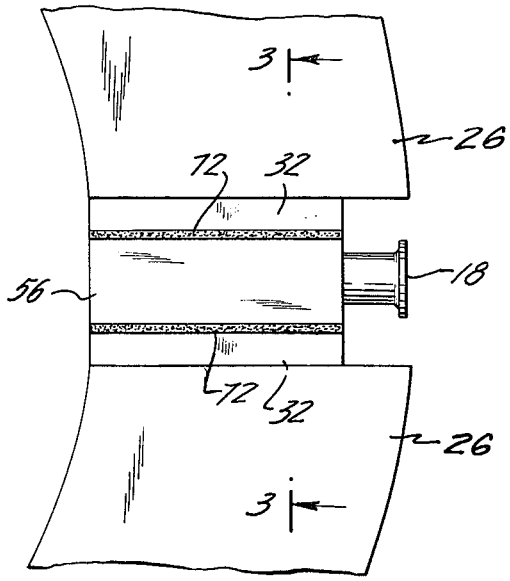
FIG. 2 is a side elevational view of one of the headers of the heat exchanger shown in FIG. 1 to which is connected two tube and tubesheet assemblies of this invention.
Figure 3:
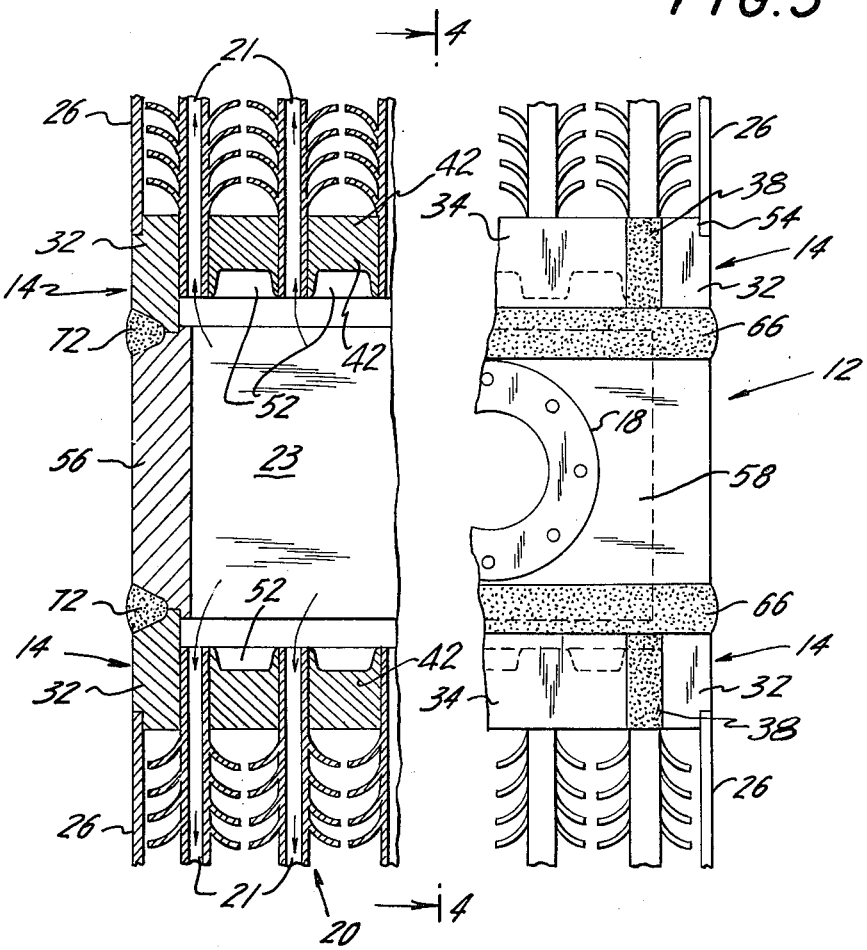
FIG. 3 is a view in end elevation of the header shown in FIG. 2 with a portion thereof shown in cross-section along line 3—3 of FIG. 2 and shown on a somewhat enlarged scale.
Figure 4:
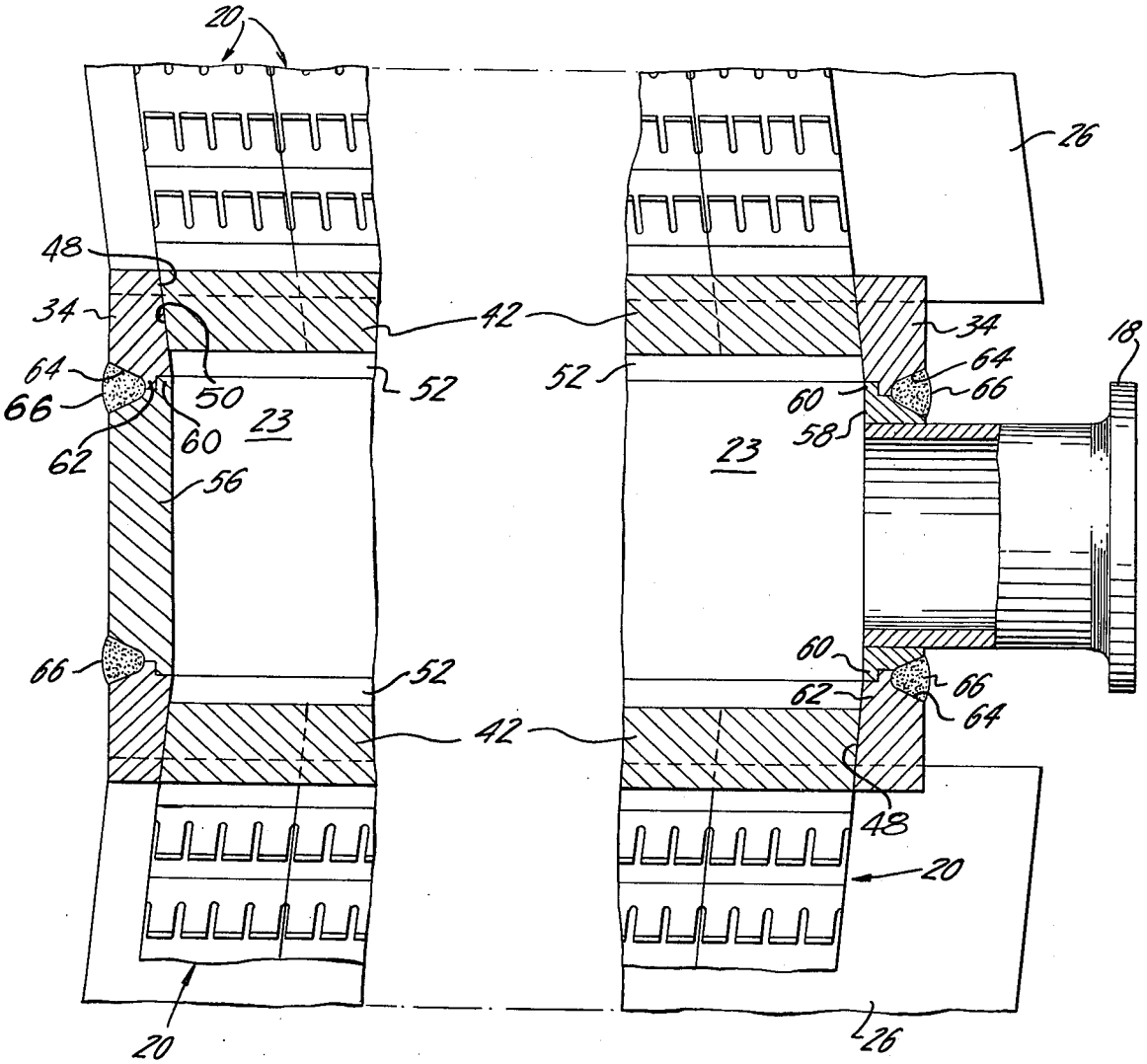
FIG. 4 is a cross-sectional view taken substantially along line 4—4 of FIG. 3 and shown on an enlarged scale.
Figure 5:
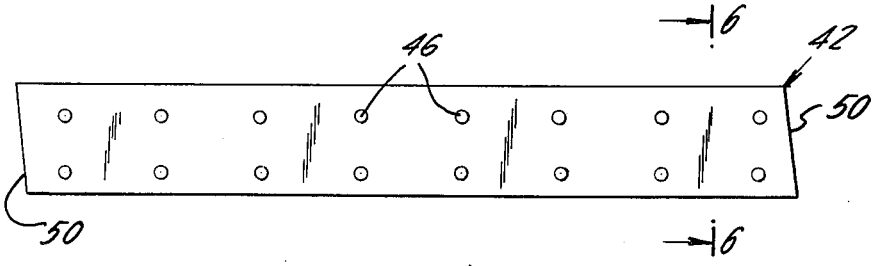
FIG. 5 is a side elevational view of a partition wall element forming part of this invention.
Figure 6:
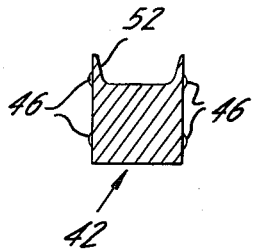
FIG. 6 is a view in cross-section taken along line 6—6 of FIG. 5.
Figure 7:
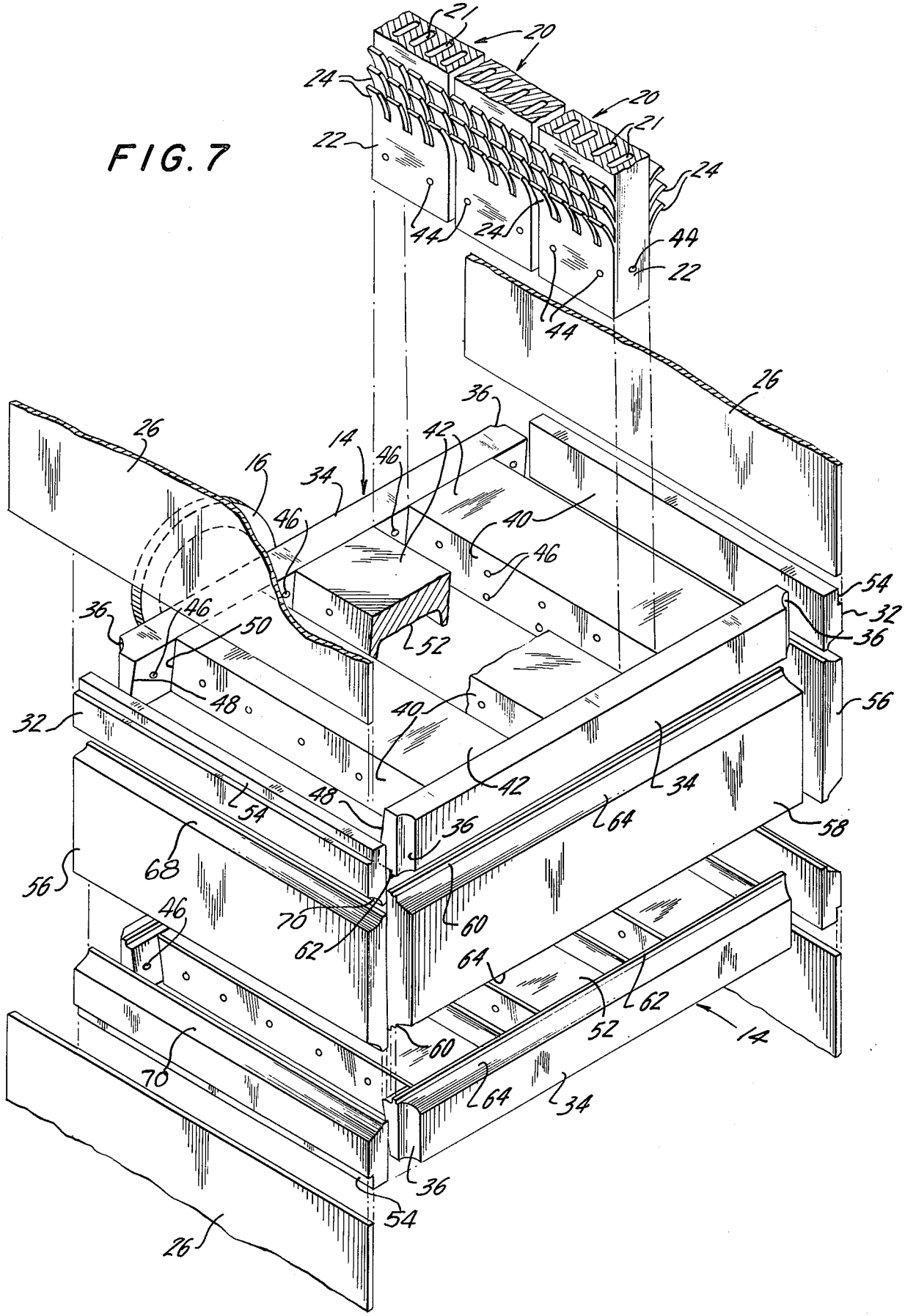
FIG. 7 is an exploded, perspective view of one of the headers of the heat exchanger shown in FIG. 1 with parts broken away for illustration purposes.

Now referring to the drawings and more specifically to FIGS. 1 to 7, the reference number 10 generally designates a heat exchanger of washer or doughnut configuration and having two headers or manifolds 12, each of which have two tube and tubesheet assemblies 14 according to this invention. One of the headers 12, serving as an inlet header for the heat exchanger, is provided with a pipe connector 16 for connection through a conduit (not shown) to a source of liquid while the other header 12 serves as an outlet header and is also provided with pipe connector 18 for attachment to a conduit (not shown) to pass the liquid to a point of use or storage (not shown). In addition, the heat exchanger has two banks of tubes, each bank comprises a plurality of tube elements 20. The opposite end portions 22 (see FIG. 7) of each of the tube elements is secured in a tube and tubesheet assembly 14. As shown in FIG. 1, each tube element 20 of each bank of tube elements is curved and has end portions 22 of non-circular cross-section which, as shown, may be of four-sided polygonal configuration in cross-section. Also, as illustrated, each tube element 20 may have extended surface elements or fins 24 in the portions of the tube elements other than end portions 22. The tube elements 20 may be of the type having skived fins as disclosed in the patent to Kritzer U.S. Pat. No. 3,229,722 or any other suitable fin type elements having end portions of non-circular configuration in cross-section. Each tube element 20 may have a single flow passage or a plurality of flow passages 21 as shown in FIG. 7 of the drawings to receive or pass liquid from or into header chamber 23 of headers 12. To guide gaseous fluid flow over the exterior surfaces of tube elements 20, washer-like baffles 26 are disposed on opposite sides of the bank of tube elements 20. Each baffle 26 is suitably secured, as best shown in FIG. 3, at its opposite ends to tube and tubesheet assemblies 14 and to each other by tie bolts 28 extending through circumferentially spaced spacer bars 30.

TUBE AND TUBESHEET CONSTRUCTION

As best illustrated in FIGS. 3 to 7, each of the tube and tubesheet assemblies 14 comprises a plurality of peripheral wall elements 32 and 34 which may be four in number and contiguously arranged to form a frame of four-sided polygonal configuration. The abutting end portions of peripheral wall elements 32 and 34 are secured together as by tack welding, soldering, brazing, or other suitable bonding material, but where rigidity is required for handling of the assembly, full strength welds are preferred. Accordingly, each of the peripheral wall elements 34 may be provided with cut-out portions 36 in the end edge portions to allow for weld beads 38 (see FIGS. 2 and 7). To divide the enclosure formed by the frame into a plurality of openings 40 to receive end portions 22 of tube elements 20, a plurality of dividing or partition wall elements 42 are disposed within the frame. The number of partition wall elements 42 is dependent upon the number of rows of tube elements in the tube bank of the heat exchanger. As shown in FIGS. 1 to 7, there are three partition wall elements 42 to form four openings 40 for accommodating four rows of tube elements. Each of the partition wall elements 42 is dimensioned to extend between peripheral wall elements 34 and in spaced parallel relationship to each other and peripheral wall elements 32. The partition wall elements are suitably secured at their opposite ends to peripheral wall elements 34 by tack welding, brazing, soldering, or by some other suitable bonding technique. As in the case of peripheral wall elements 32 and 34, partition wall elements 42 are preferably connected by full strength welding where rigidity is required in the handling of the assembly.

Obviously, the dimensions of peripheral wall elements 32 and 34 and partition wall elements 42 are selected to provide the number and the size of openings to accommodate the number of tube elements 20 in each row and allowing for a desired gap or spacing between the surfaces of the end portions 22 of tube elements 20 and the adjacent surfaces of wall elements 32 and 34. This gap is to provide an effective bonding and seal joint which joint is preferably achieved by soldering. To insure substantial uniformity in the gap between the aforementioned adjacent surfaces, each end portion 22 of tube elements 20 are provided with a plurality of spaced projections 44. These projections 44 may be formed in any suitable manner such as by being cast or machined in the surface, weld deposited, or formed by localized mechanical deformation known as staking. As best shown in FIGS. 5 and 6, the opposite side surfaces of partition wall elements 42 may also be provided with spaced projections 46, similar to projections 44, to assist the latter projections in the maintenance of the predetermined spaced relationship of tube end portions 20 and the adjacent surfaces of wall elements 32, 34 and 42.

As best shown in FIG. 7, the inner surfaces 48 of peripheral wall elements 34 are inclined to be complementary to the curvature of tube elements 20 when a heat exchanger 10 employs tube and tubesheet assemblies 14 according to this invention. In addition, the opposite end portions of partition wall elements 42 are provided with inclined surfaces 50 which are complementary to the inclination of the adjacent surface 48 against which the surfaces 50 abut. To effect a saving in weight, each of the partition wall elements 42 may be provided with an elongated recess 52 in the surface facing header chamber 23 and extending end-to-end the full length of the element (see FIGS. 4, 6 and 7).

The peripheral wall elements 32 may be provided with a cut-out longitudinal edge portion 54, each of which is dimensioned to receive the end edge portion of baffles 26. The baffles 26 may be secured in any well known manner to peripheral wall elements 32.

In heat exchanger 10, header chamber 23 of each header 12 is defined between tube and tubesheet assemblies 14 by plate elements 56 and 58 which are sealingly secured to peripheral wall elements 32 and 34 respectively. Each plate 58 has opposite longitudinal edge portions 60 notched to fit in overlapping, abutting relationship with the complementarily formed adjacent edge portion 62 of peripheral wall elements 34. Also, edge portions 60 and 62 have arcuate cut-out portions 64 which form a space to receive a weld bead 66 (see FIG. 3) which is created in welding together plate elements 58 and peripheral wall elements 34. The plate elements 56 and peripheral wall elements 32, similar to plate elements 58 and peripheral wall elements 34, have arcuate cut-out portions 68 and 70, respectively, which, when the peripheral wall elements 32 are brought into abutment with the plate elements 56, form a recess for receiving weld beads 72 (see FIGS. 2 and 3) created in welding the abutting wall elements together. The vertical abutting end portions of plate elements 56 and 58 are welded together to render header chamber 23 fluid-tight and free of leakage.

In operation of heat exchanger 10 herein described and having tube and tubesheet assemblies 14 according to this invention, a first fluid, such as steam and/or water, enters header chamber 23 of inlet header 14, via inlet connector 16, from a suitable source thereof. The fluid in the inlet header divides and enters passageways 21 in each of the tube elements 20 of the two banks of tube associated with each of the two tube and tubesheet assemblies 14. The first fluid in flowing through the two banks to the outlet header passes in heat exchange relationship with a second fluid, such as air, which is drawn or forced by suitable means (not shown) across the exterior of tube elements 20 and between baffles 26. After the first fluid passes in heat exchange relationship with the second fluid, it passes from passageways 21 of tube elements 20 into header chamber 23 of the outlet header. From the outlet header the first fluid is conducted, via outlet connector 18, to a place of use or storage (not shown). Simultaneously, the second fluid, after heat exchange, passes from the heat exchanger to a place of use, storage or is discharged to atmosphere.

Figure 8:
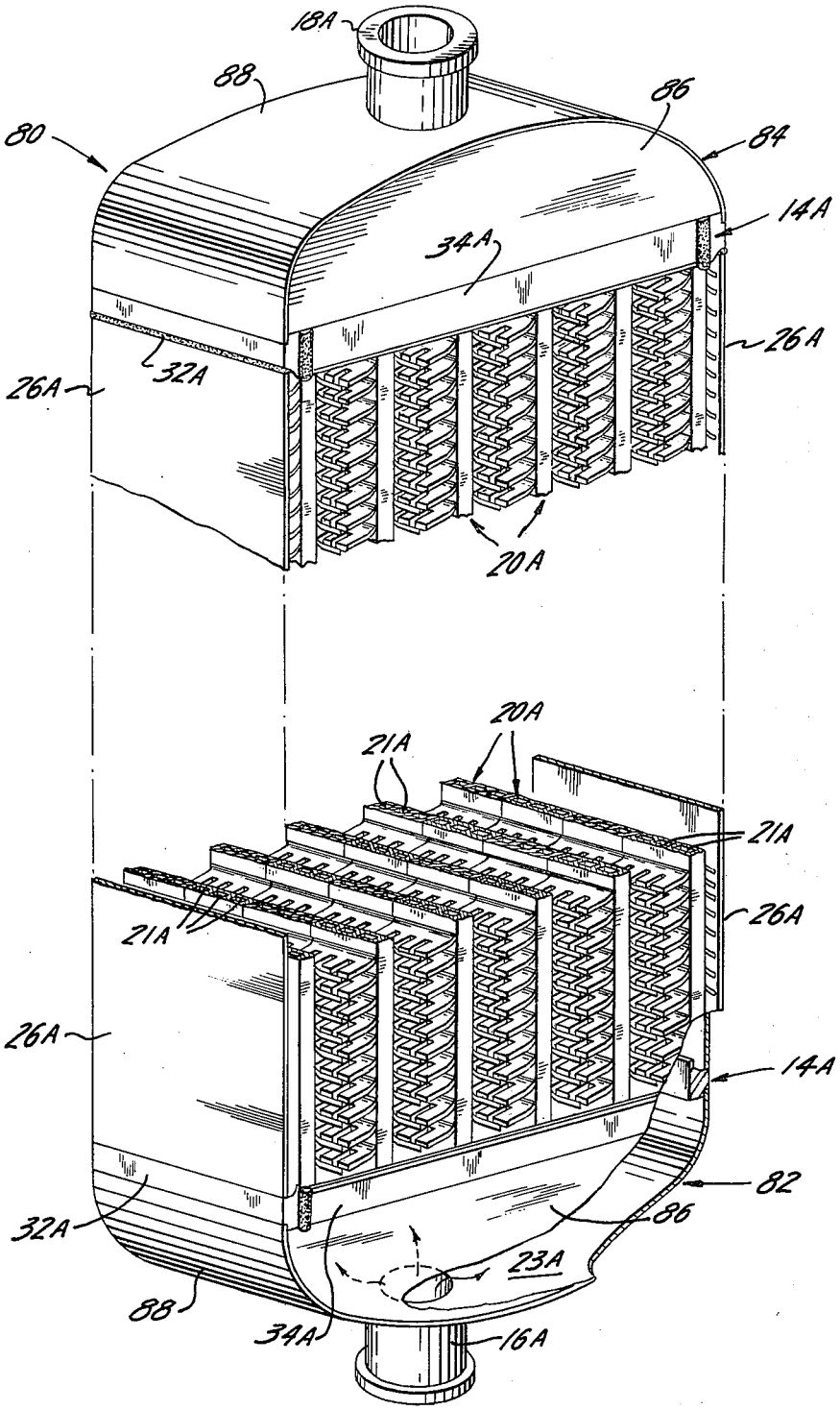
FIG. 8 is a perspective view of another type of heat exchanger having tube and tubesheet assemblies according to this invention.

In FIG. 8 is shown a heat exchanger 80 of the single pass type which may have utility as a radiator of the cooling system of a prime mover for a vehicle and, of course, essentially differs from heat exchanger 10 in that only one tube and tubesheet assembly 14A, according to this invention, is associated with the inlet and outlet headers 82 and 84, respectively. In view of the extensive similarities of heat exchangers 10 and 80, parts of heat exchanger 80 corresponding to like parts of heat exchanger 10 will be designated by the same number but with the suffix A added thereto.

Each of the two tube and tubesheet assemblies 14A of heat exchanger 80 is essentially of the same construction as each of tube and tubesheet assemblies 14 of heat exchanger 10. Since the tube elements 20A are straight and not curved as in heat exchanger 10, the only difference in the tube and tubesheet assemblies 14 and 14A is that the inner surfaces (not shown) of peripheral wall elements 34A are straight and not inclined as are surfaces 48 of peripheral wall elements 34 of tube and tubesheet assemblies 14. Another difference is that inlet and outlet headers 82 and 84 of heat exchanger 80 have plates 86 and 88 welded or otherwise suitably secured to each other and the peripheral wall elements 32A and 34A to thereby define the header chambers 23A instead of employing plate elements 56 and 58 of heat exchanger 10.

METHOD OF FABRICATION

In accordance with this invention, tube and tubesheet assemblies 14 and 14A are each fabricated in the same manner. Accordingly, only the fabrication steps of tube and tubesheet assemblies 14 of heat exchanger 10 will be described.

Each tube and tubesheet assembly 14 of heat exchanger 10 is constructed by first securing together, as by welding, peripheral wall elements 32 and 34 so as to form a frame defining an enclosure. Then, disposing one or more partition wall elements 42 in the frame and securing the opposite ends of the partition wall elements to peripheral wall elements 34. Thereafter, end portions 22 of tube elements 20 are positioned in the openings 40 formed by the partition wall elements 42 within the frame. The plate elements 56 and 58 are now welded to each other and peripheral wall elements 32 and 34. The baffle plates 26 may then be secured in abutment against peripheral wall elements 32 and connected together by tie bolts 28. The entire heat exchanger assembly is now a rigid unit which may be conveyed to an ultrasonic bath of fluxless zinc solder and entirely immersed or dipped into the bath. This dipping step effects a soldered bond of tube elements 20 to each other and the adjacent surfaces of peripheral wall elements 32 and 34 and partition wall elements 42 as well as effecting a seal of the interstices between those aforementioned surfaces so that integral, leakproof tube and tubesheet assemblies 14 are provided in the heat exchanger.

In an alternative method, the dipping step may be performed when each of the two segments of the heat exchanger are assembled and, after dipping, the step may be employed of joining the two segments together by welding plate elements 56 and 58 to each of the peripheral wall elements 32 and 34.

This same method, as previously stated, is followed in the fabrication of heat exchanger 80 with the obvious omission of the step of welding plate elements 56 and 58 to the tube and tubesheet assemblies.

It is believed now readily apparent that the present invention provides a novel built-up tube and tubesheet assembly particularly suitable for receiving tube elements having end portions of polygonal configurations in cross-section. It is a built-up tube and tubesheet assembly which has fluid-tight integrity. The invention also provides a method of fabrication of such a tube and tubesheet assembly which is relatively simple and inexpensive.

Although two embodiments of the invention have been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. A tube and tubesheet assembly for a heat exchanger having a plurality of tube elements of non-circular cross-section comprising:

a. plurality of peripheral wall elements secured together to form an enclosure;

b. at least one partition wall element disposed in said enclosure and secured at opposite ends to said peripheral walls to divide said enclosure into tube element receiving openings;

c. said tube elements having end portions disposed in said openings;

d. spacer means coacting with said tube elements and said peripheral and partition walls adjacent thereto to position said tube elements in a predetermined close spaced relationship with said adjacent peripheral and partition walls; and e. securing means for connecting said tube elements and said peripheral and partition wall elements together and for sealing the interstices between the end portions of the tube elements and the adjacent peripheral and partition wall elements.

2. The apparatus of cliam 1 wherein said plurality of peripheral wall elements define a four-sided polygonal enclosure.

3. The apparatus of claim 2 wherein said partition wall extends from one peripheral wall to an opposite peripheral wall.

4. The apparatus of claim 3 wherein said partition wall defines with the peripheral walls two four-sided polygonal shaped openings.

5. The apparatus of claim 1 wherein said securing and sealing means is molten metal.

6. The apparatus of claim 1 wherein said securing and sealing means is fluxless zinc solder.

7. A tube and tubesheet assembly for a heat exchanger having a plurality of tube elements each of which have end portions of four-sided polygonal shape in cross-section comprising:

a. a plurality of peripheral wall elements secured together to form a four-sided polygonal frame defining an enclosure;

b. at least one partition wall disposed in said enclosure and secured at opposite ends to opposite peripheral walls to form two openings shaped and dimensioned to receive therein the said portions of said tube elements;

c. spacer means integral with the end portions of said tube elements coacting with said adjacent peripheral and partition walls to position said end portions of the tubes in a predeterminted close spaced relationship with the adjacent peripheral and partition walls; and d. securing and sealing means for connecting said end portions of the tube elements and the peripheral and partition walls together and sealing the interstices provided by the spacer means between the end portions of the tube elements and the adjacent peripheral and partition walls.

8. The apparatus of claim 7 wherein said tube elements are provided with extended surface elements other than at said end portions thereof.

9. The apparatus of claim 7 wherein said assembly has a plurality of partition walls disposed in substantially parallel relationship to each other to form a plurality of spaced substantially parallel openings in said enclosure.

10. The apparatus of claim 7 wherein said securing and sealing means is zinc solder.

11. The apparatus of claim 7 wherein a closure means is secured to the peripheral walls to form a header.

* * * * *